US009564083B2

(12) United States Patent
Bae

(10) Patent No.: US 9,564,083 B2
(45) Date of Patent: Feb. 7, 2017

(54) ORGANIC LIGHT EMITTING DISPLAY DEVICE HAVING A WIRING CONNECTING A FIRST PIXEL WITH A SECOND PIXEL

(71) Applicant: SAMSUNG DISPLAY CO., LTD., Yongin, Gyeonggi-Do (KR)

(72) Inventor: Han-Sung Bae, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 5 days.

(21) Appl. No.: 14/568,847

(22) Filed: Dec. 12, 2014

(65) Prior Publication Data

US 2015/0170576 A1 Jun. 18, 2015

(30) Foreign Application Priority Data

Dec. 17, 2013 (KR) ..... 10-2013-0157254

(51) Int. Cl.

*G09G 3/30* (2006.01)
*G09G 3/32* (2016.01)
*G09G 3/10* (2006.01)

(52) U.S. Cl.

CPC ..... *G09G 3/3266* (2013.01); *G09G 3/3225* (2013.01); *G09G 2300/0861* (2013.01); *G09G 2310/0262* (2013.01); *G09G 2320/0238* (2013.01)

(58) Field of Classification Search

CPC .. G09G 3/3233; G09G 3/3266; G09G 3/3225; G09G 2300/0895; G09G 2310/0262; G09G 2320/0238

USPC ..... 345/76; 315/169.3

See application file for complete search history.

(56) References Cited

U.S. PATENT DOCUMENTS

2002/0195964 A1 12/2002 Yumoto
2006/0244695 A1* 11/2006 Komiya ..... G09G 3/006 345/76
2007/0126665 A1* 6/2007 Kimura ..... G09G 3/3233 345/76
2008/0150846 A1* 6/2008 Chung ..... G09G 3/3233 345/76

(Continued)

FOREIGN PATENT DOCUMENTS

KR 2002-0092220 12/2002
KR 10-1064471 9/2011

(Continued)

*Primary Examiner* — Adam J Snyder

(74) *Attorney, Agent, or Firm* — Lewis Roca Rothgerber Christie LLP

(57) ABSTRACT

An organic light emitting display device includes: a scan driver configured to sequentially supply a scan signal to scan lines, and supply an emission control signal to emission control lines; a data driver configured to supply a data signal to data lines; a pixel unit (pixel region) including pixels connected with the scan lines, the emission control lines, and the data lines and receiving a first power source which is a high potential pixel power source, a second power source which is a low potential pixel power source, and a third power source which is an initialization power source; and a wiring connecting an anode electrode of an organic light emitting diode of a first pixel in a first horizontal line and a first electrode of a transistor connected with the third power source of a second pixel in a second horizontal line while being adjacent to the first pixel.

13 Claims, 7 Drawing Sheets

(56) References Cited

U.S. PATENT DOCUMENTS

| | | | | |
|---|---|---|---|---|
| 2008/0169754 | A1* | 7/2008 | Yang | G09G 3/3233 313/504 |
| 2009/0201231 | A1* | 8/2009 | Takahara | G09G 3/3233 345/76 |
| 2009/0243977 | A1* | 10/2009 | Chung | G09G 3/3233 345/76 |
| 2010/0013816 | A1* | 1/2010 | Kwak | G09G 3/3233 345/76 |
| 2010/0149160 | A1* | 6/2010 | Kimura | G09G 3/3233 345/211 |
| 2011/0080395 | A1* | 4/2011 | Chung | G09G 3/3233 345/76 |
| 2011/0227908 | A1* | 9/2011 | Choi | G09G 3/3233 345/76 |
| 2012/0001893 | A1* | 1/2012 | Jeong | G09G 3/3233 345/76 |
| 2012/0001896 | A1* | 1/2012 | Han | G09G 3/3233 345/76 |

FOREIGN PATENT DOCUMENTS

| | | |
|---|---|---|
| KR | 10-2012-0002070 | 1/2012 |
| KR | 10-2012-0002071 | 1/2012 |
| KR | 10-2012-0138924 | 12/2012 |

* cited by examiner

ORGANIC LIGHT EMITTING DISPLAY DEVICE HAVING A WIRING CONNECTING A FIRST PIXEL WITH A SECOND PIXEL

CROSS-REFERENCE TO RELATED APPLICATION

This application claims priority to and the benefit of Korean Patent Application No. 10-2013-0157254, filed on Dec. 17, 2013, in the Korean Intellectual Property Office, the entire content of which is incorporated herein by reference in its entirety.

BACKGROUND

1. Field

An aspect of an embodiment of the present invention relates to a display device, and more particularly, to an organic light emitting display device.

2. Description of the Related Art

Recently, various flat panel display devices, which are lighter and have smaller volume compared to a cathode ray tube, have been developed.

Particularly, an organic light emitting display device among the flat panel display devices display an image by using (utilizing) an organic light emitting diode, which is a self-light emitting device, thereby exhibiting excellent luminance and color purity and thus attracting attention as a next generation display device.

The organic light emitting display device is divided into a Passive Matrix Organic Light Emitting Diode (PMOLED) and an Active Matrix Organic Light Emitting Diode (AMOLED).

The AMOLED includes a plurality of pixels positioned at cross portions (regions) of scan lines and data lines. Further, each pixel includes an organic light emitting diode and a pixel circuit for driving the organic light emitting diode. The pixel circuit is typically formed of a switching transistor, a driving transistor, and a storage capacitor.

The AMOLED has an advantage of low power consumption, thereby usefully used in a portable display device and the like.

However, in the case of the AMOLED, a small leakage current may be generated in the driving transistor while implementing a black image due to a device characteristic of the driving transistor included in the pixel circuit, and luminance to implement the black image (black luminance) is increased by the leakage current, so that the black image fails to display complete black.

This causes deterioration of a contract ratio quality of the organic light emitting display device.

SUMMARY

An aspect of an embodiment of the present invention is directed toward an organic light emitting display device with a layout of pixels for preventing (or protecting from) an increase in black luminance.

An exemplary embodiment of the present invention provides an organic light emitting display device, including: a scan driver configured to sequentially supply a scan signal to scan lines, and supply an emission control signal to emission control lines; a data driver configured to supply a data signal to data lines; and a pixel unit including a plurality of pixels connected with the scan lines, the emission control lines, and the data lines and receiving a first power source which is a high potential pixel power source, a second power source which is a low potential pixel power source, a third power source which is an initialization power source, and a wiring connecting an anode electrode of an organic light emitting diode of a first pixel of the pixels, the first pixel being arranged in a first horizontal line and a first electrode of a transistor connected with the third power source of a second pixel of the pixels, the second pixel being arranged in a second horizontal line while being adjacent to the first pixel.

Each of the pixels may include: an organic light emitting diode connected between the first power source and the second power source; a first transistor connected between the first power source and the organic light emitting diode and including a gate electrode connected to a first node; a second transistor connected between a first electrode of the first transistor connected to the first power source and a data line of the data lines and including a gate electrode connected to a current scan line of the scan lines; a third transistor connected between a second electrode of the first transistor connected to the organic light emitting diode and the first node and including a gate electrode connected to the current scan line; a fourth transistor connected between the second electrode of the first transistor and the organic light emitting diode and including a gate electrode connected to an emission control line of the emission control lines; a fifth transistor connected between the first node and the third power source and including a gate electrode connected to a previous scan line of the scan lines; and a storage capacitor connected between the first power source and the first node.

Further, each of the pixels further may include a sixth transistor connected between a first electrode of the fifth transistor and the first node, and gate electrodes of the fifth transistor and the sixth transistor are commonly connected to the previous scan line.

Further, a connection node of the fourth transistor and the organic light emitting diode of the pixel (first pixel) may be connected to a connection node of the fifth transistor and the sixth transistor of the pixel (second pixel) arranged in a next horizontal line adjacent to the pixel (first pixel).

The fifth and sixth transistors of the second pixel may be turned on for a period for which a current scan signal is applied to the first pixel, so that a current path from the anode electrode of the organic light emitting diode of the first pixel to the third power source via the fifth transistor of the second pixel may be formed.

Each of the pixels further may include a seventh transistor connected between the first power source and the first electrode of the first transistor and including a gate electrode connected to the emission control line.

Further, a voltage of the third power source may be set to a voltage with a low level, and the voltage with the low level may be set to be lower than a lowest voltage among gray voltages of the data signal.

Further, the scan driver may supply a first emission control signal, by which the fourth transistor is turned off, to the emission control line for a first period for which a previous scan signal is supplied to the previous scan line and a second period for which a current scan signal is supplied to the current scan line, and supply a second emission control signal, by which the fourth transistor is turned on, to the emission control line for a third period after the first and second periods. The first emission control signal may be at a first voltage, and the second emission control signal may be at a second voltage different from the first voltage.

According to the exemplary embodiment of the present invention, wiring connecting the connection node connected with the anode electrode of the organic light emitting diode of the first pixel arranged in the first horizontal line to the connection node between the initialization transistors of the second pixel, which is arranged in the second horizontal line while being adjacent to the first pixel, not the same pixel is formed, so that it is possible to prevent an increase in black luminance by reducing or minimizing application of a leakage current generated from the driving transistor of the first pixel to the organic light emitting diode of the first pixel, and enhancing layouts of each of the pixels so as to implement a high resolution.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Hereinafter, the present invention will be described in more detail with reference to the accompanying drawing.

Figure 1:
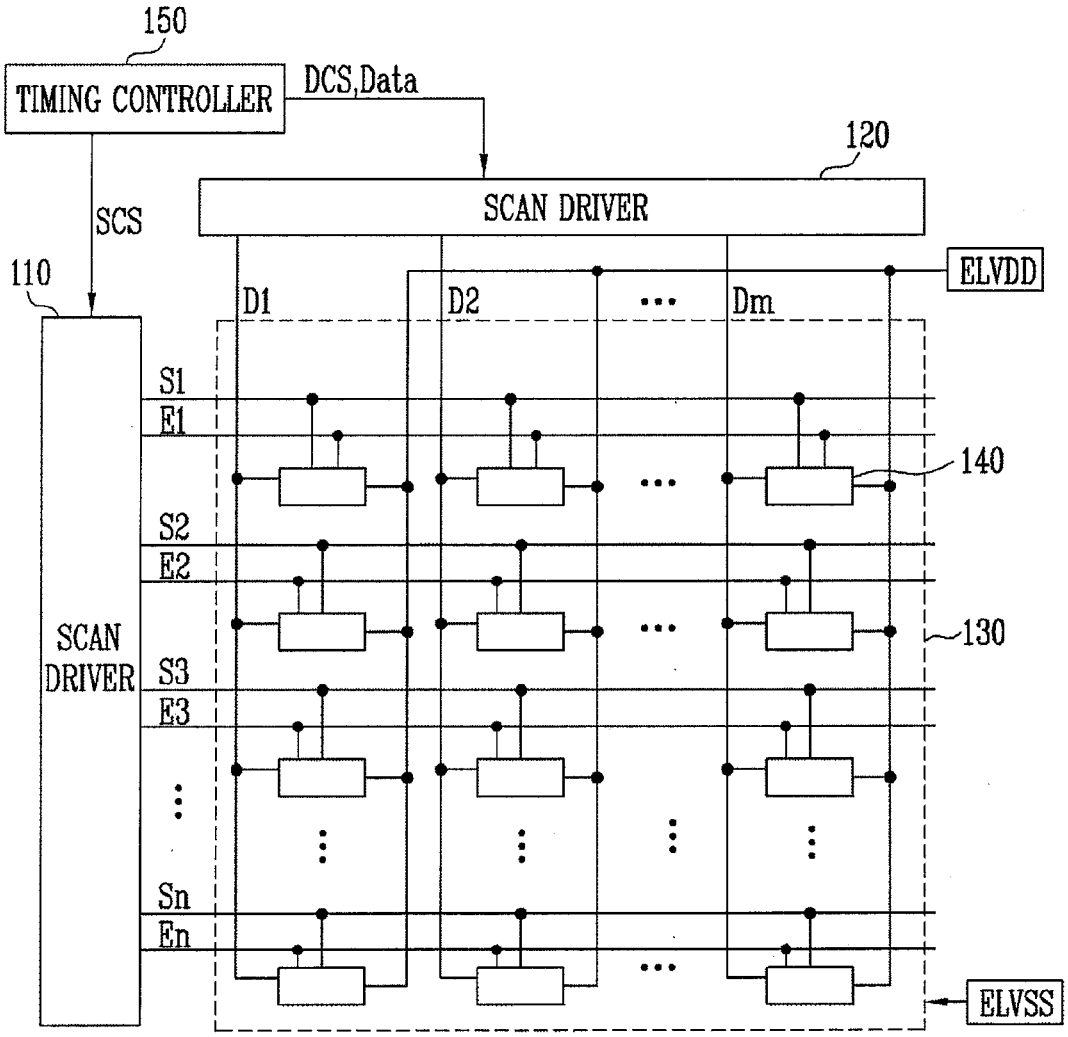
FIG. 1 is a block diagram schematically illustrating a structure of an organic light emitting display device according to an exemplary embodiment of the present invention.

FIG. 1 is a block diagram schematically illustrating a structure of an organic light emitting display device according to an exemplary embodiment of the present invention.

Referring to FIG. 1, an organic light emitting display device according to an exemplary embodiment of the present invention includes a pixel unit (pixel region) 130 including a plurality of pixels located at crossing portions (regions) of scan lines S1 to Sn, emission control lines E1 to En, and data lines D1 to Dm, a scan driver 110 for driving the scan lines S1 to Sn and the emission control lines E1 to En, a data driver 120 for driving the data lines D1 to Em, and a timing controller 150 for controlling the scan driver 110 and the data driver 120.

The scan driver 110 receives a scan driving control signal SCS from the timing controller 150. The scan driver 110 receiving the scan driving control signal SCS generates a scan signal, and sequentially supplies the generated scan signal to the scan lines S1 to Sn.

Further, the scan driver 110 supplies an emission control signal to the emission control lines E1 to En formed in parallel with the scan lines S1 to Sn in response to the scan driving control signal SCS.

In the meantime, FIG. 1 illustrates that the pixels 140 are each connected to one scan line, that is, a current scan line, but the pixels 140 of the present invention may be connected to two scan lines. For example, the pixels 140 located in an ith horizontal line (i is a natural number) may be connected to an ith scan line Si that is a current scan line and an i−1th scan line Si−1 that is a previous scan line.

That is, the pixels 140 arranged in the ith horizontal line may be connected to the i-ith scan line Si−1 that is the previous scan line of the ith horizontal line and the ith scan line Si that is the current scan line corresponding to the ith horizontal line.

In the case of the exemplary embodiment of the present invention, the scan driver 110 may sequentially supply the scan signal (by which set or predetermined transistors, for example, an initialization transistor and a switching transistor, included in each of the pixels 140 are controlled to be turned on) to the scan lines SI to Sn.

That is, for example, based on the pixels 140 arranged in the ith horizontal line, the initialization transistor included in each of the pixels is turned on for an initialization period that is a period for which a previous scan signal is supplied to the pixels connected to the i−1th scan line Si−1, and the switching transistor included in each of the pixels is turned on for a scanning period (or a data programming period) for which the current scan signal is supplied to the ith scan line Si.

Further, the scan driver 110 may supply the emission control signal turning off the emission control transistors included in the pixels for the initialization and scanning periods, and supply the emission control signal by which the emission control transistors are turned on for an emission period after supply of the current scan signal to the pixels is completed.

In the meantime, for convenience, FIG. 1 illustrates that one scan driver 110 generates and outputs all of the scan signal and the emission control signal, but the present invention is not limited thereto.

That is, the plurality of scan drivers 110 may separate the driving circuit supplying the scan signal and the driving circuit supplying the emission control signal to be at different sides of the pixel unit 130 or may generate and output the scan signal from the driving circuit generating and outputting the emission control signal. In addition, one of the driving circuits may be referred to as the scan driver and the other one of the driving circuits may be referred to as an emission control driver. In this case, the scan driver and the emission control driver may be formed at the same side of the pixel unit 130, or at different opposing lateral sides of the pixel unit.

The data driver 120 receives a data driving control signal DCS from the timing controller 150. The data driver 120 receiving the data driving control signal DCS generates a data signal corresponding to the data driving control signal DCS, and supplies the generated data signal to the data lines D1 to Dm.

The timing controller 150 generates the data driving control signal DCS and the scan driving control signal SCS in response to synchronization signals supplied from the outside. The data driving control signal DCS generated by the timing controller 150 is supplied to the data driver 120, and the scan driving control signal SCS is supplied to the scan driver 110. The timing controller 150 supplies data Data supplied from the outside to the data driver 120.

The pixel unit 130 receives a first power source ELVDD that is a high potential pixel power source and a second power source ELVSS that is a low potential pixel power source from the outside and supplies the received first power source ELVDD and second power source ELVSS to each of the pixels 140. Each of the pixels 140 receiving the first power source ELVDD and second power source ELVSS generates light corresponding to the data signal.

Further, the pixel unit 130 may further receive a third power source, such as an initialization power source, and supply the received third power source to each of the pixels 140.

Figure 2:
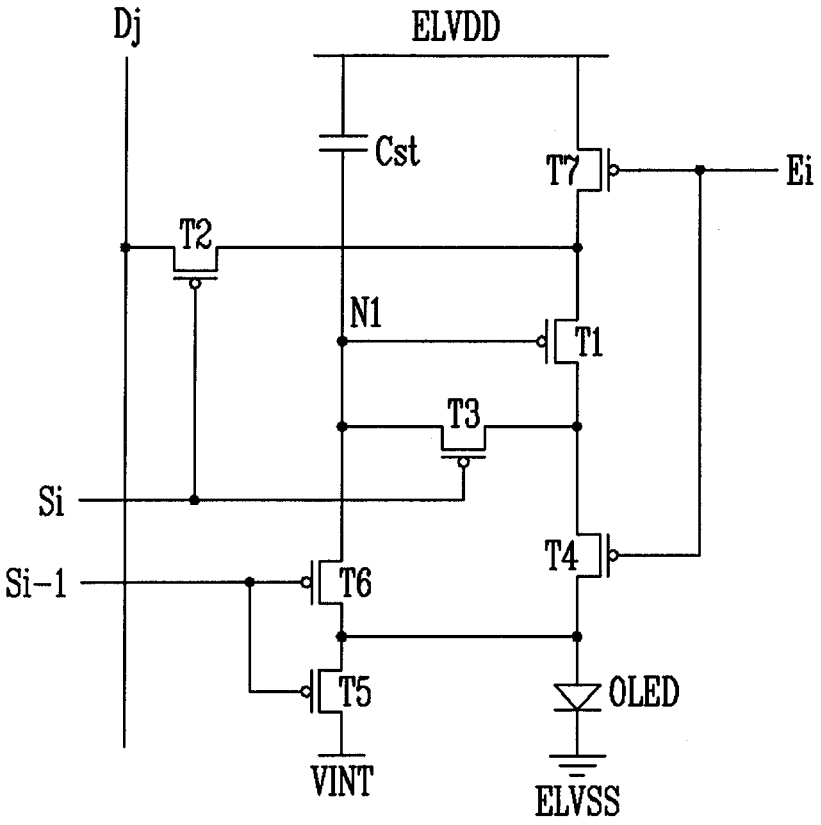
FIG. 2 is a circuit diagram illustrating a pixel of the organic light emitting display device according to the exemplary embodiment of the present invention.

FIG. 2 is a circuit diagram illustrating the pixel of the organic light emitting display device according to the exemplary embodiment of the present invention. For convenience, FIG. 2 illustrates a pixel located in an ith horizontal line (i is a natural number) and connected to a jth data line Dj.

Referring to FIG. 2, the pixel of the organic light emitting display device according to the exemplary embodiment of the present invention includes an organic light emitting diode OLED connected between the first power source ELVDD and the second power source ELVSS, a first transistor T1 connected between the first power source ELVDD and the organic light emitting diode OLED, a second transistor T2 connected between a first electrode of the first transistor T1 and the data line Dj, a third transistor T3 connected between a second electrode and a gate electrode of the first transistor T1, a fourth transistor T4 connected between the second electrode of the first transistor T1 and the organic light emitting diode OLED, a fifth transistor T5 connected between a connection node of a second electrode of the fourth transistor T4 and the organic light emitting diode OLED and a third power source VINT that is the initialization power source, a sixth transistor T6 connected between a first node N1 connected with the gate electrode of the first transistor T1 and a first electrode of the fifth transistor T5, a seventh transistor T7 connected between the first power source ELVDD and the first electrode of the first transistor T1, and a storage capacitor Cst connected between the first power source ELVDD and the first node N1.

Here, the fifth and sixth transistors T5 and T6 are serially connected in a dual type (dual manner) between the first node N1 and the third power source VINT.

Further, as illustrated, a case where the first to seventh transistors are implemented by PMOSs will be described as an example.

More particularly, the first electrode of the first transistor T1 is connected to the first power source ELVDD via the seventh transistor T7, and the second electrode is connected to the organic light emitting diode OLED via the fourth transistor T4. Here, the first electrode and the second electrode are different electrodes, and for example, the first electrode is a source electrode and the second electrode is a drain electrode. Further, the gate electrode of the first transistor T1 is connected to the first node N1.

The first transistor T1 controls a driving current supplied to the organic light emitting diode OLED in response to a voltage of the first node N1, and serves as a driving transistor of the pixel.

The first electrode of the second transistor T2 is connected to the data line Dj, and the second electrode is connected to the first electrode of the first transistor T1. Particularly, the second electrode of the second transistor T2 is connected to the first node N1 via the first and third transistors T1 and T3 when the first and third transistors T1 and T3 are turned on. Further, the gate electrode of the second transistor T2 is connected to the current scan line Si.

The second transistor T2 serves as a switching transistor which is turned on when the current scan signal is supplied from the current scan line Si and transmits a data signal supplied from the data line Dj into the pixel.

A first electrode of the third transistor T3 is connected to the second electrode of the first transistor T1, and a second electrode thereof is connected to the first node N1 to which the gate electrode of the first transistor T1 is connected. Further, a gate electrode of the third transistor T3 is connected to the current scan line Si.

The third transistor T3 is turned on when the current scan signal is supplied from the current scan line Si to connect the first transistor T1 in a diode form.

A first electrode of the fourth transistor T4 is connected to the second electrode of the first transistor T1, and a second electrode thereof is connected to the organic light emitting diode OLED, for example, an anode electrode of the organic light emitting diode OLED. Further, a gate electrode of the fourth transistor T4 is connected to the emission control line En.

The fourth transistor T4, which serves as the emission control transistor, is turned on or turned off in response to the emission control signal supplied from the emission control line Ei to form a current path within the pixel or block the current path from being formed.

A first electrode of the fifth transistor T5 is connected to the fourth transistor T4 and a connection node of the organic light emitting diode OLED, and a second electrode thereof is connected to the third power source VINT. Further, a gate electrode of the fifth transistor T5 is connected to the previous scan line Si−1. The fifth transistor T5 is turned on when the previous scan signal is supplied from the previous scan line Si−1 to connect the second electrode of the fourth transistor T4 to the third power source VINT.

A first electrode of the sixth transistor T6 is connected to the first node N1, and a second electrode thereof is connected to the first electrode of the fifth transistor T5. Further, a gate electrode of the sixth transistor T6 is connected to the previous scan line Si−1.

That is, the fifth transistor T5 and the sixth transistor T6 are serially connected in a dual type (dual manner) between the first node N1 and the third power source VINT and turned on together when the previous scan signal is supplied to the previous scan line Si−1.

The fifth transistor T5 and the sixth transistor T6 serve as the initialization transistors, and when the fifth transistor T5 and the sixth transistor T6 are turned on, a voltage of the third power source VINT is applied to the first node N1, so that the first node N1 is initialized.

A first electrode of the seventh transistor T7 is connected to the first power source ELVDD, and a second electrode thereof is connected to the first electrode of the first transistor T1. Further, a gate electrode of the seventh transistor T7 is connected to the emission control line En.

The seventh transistor T7, which serves as the emission control transistor like the fourth transistor T4, is turned on or turned off in response to the emission control signal supplied from the emission control line Ei to form a current path within the pixel or block the current path from being formed.

The storage capacitor Cst is connected between the first power source ELVDD and the first node N1 to charge a voltage corresponding to a voltage supplied to the first node N1.

However, in the case of the exemplary embodiment illustrated in FIG. 2, the connection node of the fifth transistor T5 and the sixth transistor T6 is connected to the connection node between the fourth transistor T4 and the organic light emitting diode OLED.

Further, the emission control signal, by which the fourth transistor T4 and the seventh transistor T7 are turned on, for a first period in the initialization period, for which the previous scan signal is supplied to the previous scan line Si−1, may be supplied to the emission control line En.

In this case, a current path heading from the first power source ELVDD to the third power source VINT via the seventh transistor T7, the first transistor T1, the fourth transistor T4, and the fifth transistor T5 for the first period in the initialization period.

That is, the pixel according to the present exemplary embodiment makes a set or predetermined current flow in the first transistor T1 before a data programming period and the emission period, thereby preventing or reducing deterioration of a response speed of the pixel due to hysteresis of the driving transistor.

That is, even though the pixel displays high luminance (for example, white) after displaying low luminance (for example, black) over a long time, the pixel makes a set or predetermined current for compensating for hysteresis flow in the first transistor T1, so that a target luminance value is exhibited at the beginning of a high luminance display period, thereby improving a response speed of the pixel.

Further, according to the present exemplary embodiment, the pixel is initialized by using (utilizing) the fifth transistor T5 and the sixth transistor T6 serially connected in the dual type (dual manner) between the gate electrode of the driving transistor, that is, the first transistor T1, and the third power source VINT, and the connection node of the fifth transistor T5 and the sixth transistor T6 is connected to the connection node between the fourth transistor T4, which controls light emission between the first transistor T1 and the organic light emitting diode OLED, and the organic light emitting diode OLED.

Further, for the first period in the initialization period for which the previous scan signal is supplied to the previous scan line Si−1, a current path bypassing the fifth transistor T5 and the third power source VINT connected in parallel to the organic light emitting diode OLED from the first power source ELVDD via the first transistor is formed.

Accordingly, the organic light emitting diode OLED is prevented from emitting light during (for) the initialization period, thereby solving a problem of deterioration of a response speed due to hysteresis of the first transistor T1 while preventing (or protecting from) an increase of black luminance.

However, as illustrated in FIG. 2, the pixel according to the exemplary embodiment of FIG. 2 is implemented in a structure in which a first connection node of the fifth transistor T5 and the sixth transistor T6 is connected to a second connection node between the fourth transistor T4 and the organic light emitting diode OLED included in the same pixel, and when the pixel circuit illustrated in FIG. 2 is actually designed by a layout on a substrate, a position of the first connection node is spaced apart from a position of the second connection node. Accordingly, when the first and second connection nodes are connected with a wire within the same pixel, a size of the pixel is increased by a space in which the wire is connected, so that it is disadvantageously difficult to implement high resolution in views of a layout.

The gate electrodes of the fifth and sixth transistors T5 and T6 are connected to the previous scan line Si−1, and in this case, there is a design limitation that the fifth and sixth transistors T5 and T6 need to be arranged at positions close to the previous scan line Si−1 while designing the layout.

Another exemplary embodiment of the present invention is characterized by forming wiring connecting a connection node connected with the anode electrode of an organic light emitting diode of a first pixel arranged in a first horizontal line to a connection node between initialization transistors of a second pixel arranged in a second horizontal line while being adjacent to the first pixel, not the same pixel in order to overcome the aforementioned disadvantage. Accordingly, application of a leakage current generated from a driving transistor of the first pixel to the organic light emitting diode of the first pixel may be reduced or minimized, thereby preventing an increase in black luminance, and enhancing layouts of each pixel so as to implement high resolution.

Figure 3:
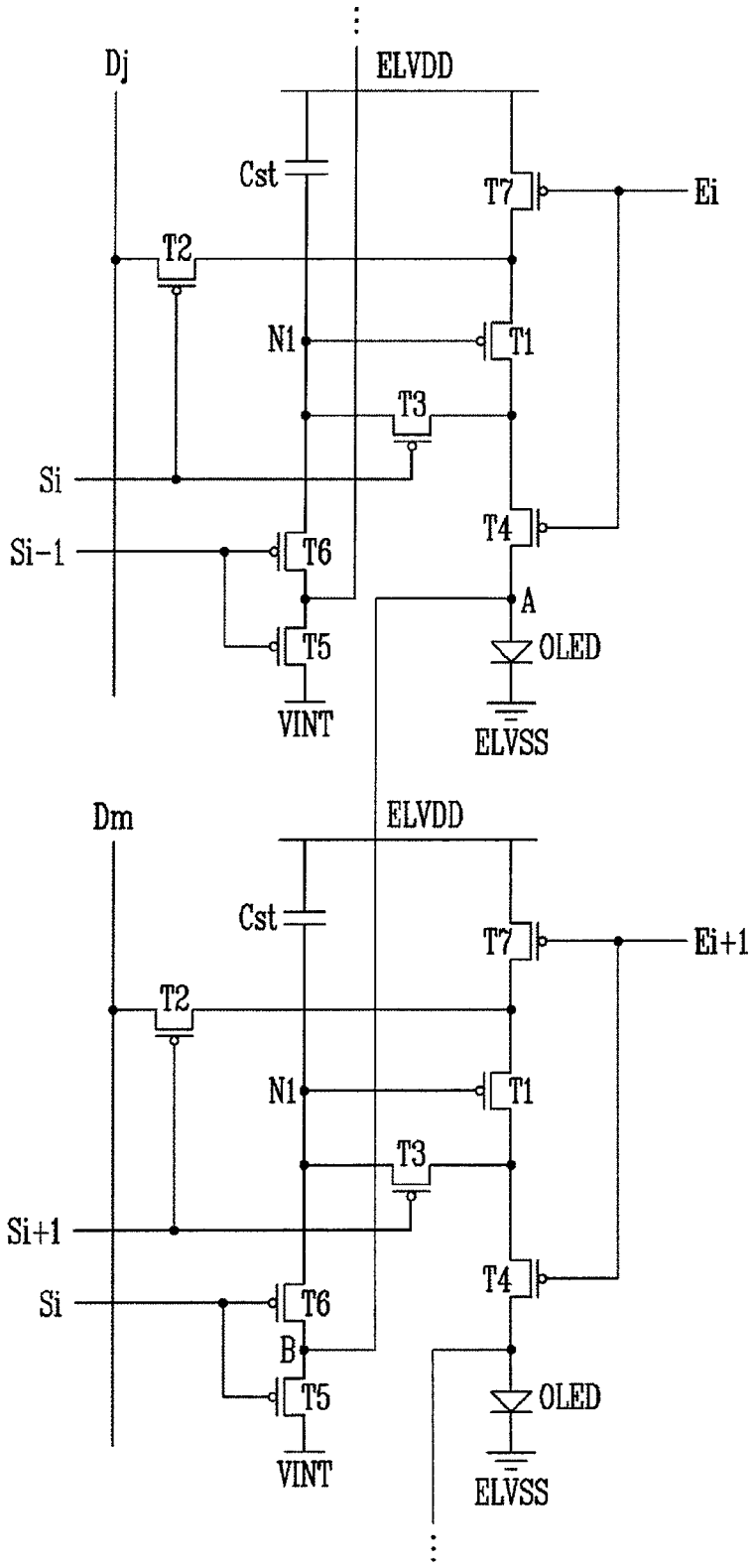
FIG. 3 is a circuit diagram illustrating a pixel of an organic light emitting display device according to another exemplary embodiment of the present invention.
Figure 4:
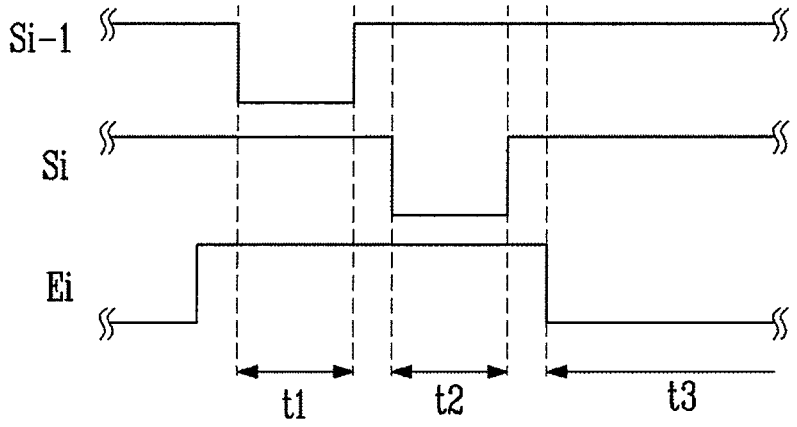
FIG. 4 is a waveform diagram illustrating driving signals for driving the pixel illustrated in FIG. 3.

FIG. 3 is a circuit diagram illustrating a pixel of an organic light emitting display device according to another exemplary embodiment of the present invention, and FIG. 4 is a waveform diagram illustrating driving signals for driving the pixel illustrated in FIG. 3.

For convenience, FIG. 3 illustrates pixels (a first pixel and a second pixel) located in ith and i+1th horizontal lines (i and i+1 are natural numbers) and connected with a jth data line Dj.

Further, the same configuration as that of the pixel structure illustrated in FIG. 2 is denoted with the same reference number, and a detailed description thereof will be omitted.

Referring to FIG. 3, the pixel of the organic light emitting display device according to another exemplary embodiment of the present invention has the same structure as that of the pixel illustrated in FIG. 2 except for a fact that wiring connecting a connection node A connected with an anode electrode of the organic light emitting diode of the first pixel arranged in a first horizontal line (ith horizontal line) to a connection node B between initialization transistors of the second pixel arranged in a second horizontal line (i+1th horizontal line) while being adjacent to the first pixel (but not the same pixel) is formed.

For example, the pixel (second pixel) arranged in the i+1th horizontal line includes an organic light emitting diode OLED connected between a first power source ELVDD and a second power source ELVSS, a first transistor T1 connected between the first power source ELVDD and the organic light emitting diode OLED, a second transistor T2 connected between a first electrode of the first transistor T1 and a data line Dj, a third transistor T3 connected between a second electrode and a gate electrode of the first transistor T1, a fourth transistor T4 connected between the second electrode of the first transistor T1 and the organic light emitting diode OLED, a fifth transistor T5 connected between the connection node A of the second electrode of the fourth transistor T4 and the organic light emitting diode OLED of the pixel arranged in a previous horizontal line, that is, the ith horizontal line and the third power source VINT that is an initialization power source, a sixth transistor T6 connected between a first node to which the gate electrode of the first transistor T1 is connected and a connection node B to which a first electrode of the fifth transistor T5 is connected, a seventh transistor T7 connected between the first power source ELVDD and the first electrode of the first transistor, and a storage capacitor connected between the first power source ELVDD and the first node N1.

Here, the fifth and sixth transistors T5 and T6 are serially connected in a dual type (dual manner) between the first node N1 and the third power source VINT.

That is, the pixel according to the exemplary embodiment illustrated in FIG. 3 is structurally characterized by forming wiring connecting the anode electrode of the organic light emitting diode of the first pixel arranged in the first horizontal line (ith horizontal line) and the first electrode of the fifth transistor T5 connected to the third power source VINT of the second pixel arranged in the second horizontal line (i+1th horizontal line) while being adjacent to the first pixel.

Further, the pixel illustrated in FIG. 3 may be driven by application of a signal illustrated in FIG. 4.

Referring to FIG. 4, a previous scan signal and a current scan signal are sequentially supplied to the previous scan line Si−1 and the current scan line Si. Here, the previous scan signal and the current scan signal are set to a voltage (for example, a low voltage) by which the transistors included in the pixel, particularly, the second and third transistors T2 and T3 and the fifth and sixth transistors T5 and T6 of FIG. 3 may be turned on.

For example, based on the first pixel arranged in the ith horizontal line, the fifth and sixth transistors T5 and T6, which are the initialization transistors, included in the first pixel are turned on for an initialization period that is a period to which the previous scan signal is supplied to the first pixel connected to the i−1th scan line Si−1, and the second transistor T2 that is a switching transistor included in the first pixel is turned on for a scanning period (or data programming period) for which the current scan signal is supplied to the ith scan line Si.

Further, an emission control signal supplied to the emission control line Ei is set to a voltage (for example, a high voltage) by which the fourth and seventh transistors T4 and T7 which are the emission control transistors may be turned off for a period for which the previous scan signal and the current scan signal are applied to the first pixel, and then set to a voltage by which the fourth and seventh transistors T4 and T7 may be turned on for an emission period after the supply of the current scan signal is completed.

An operation process of the pixel illustrated in FIG. 3 driven by driving signals of FIG. 4 will be described in detail below with reference to FIGS. 5A to 5C.

Figure 5A:
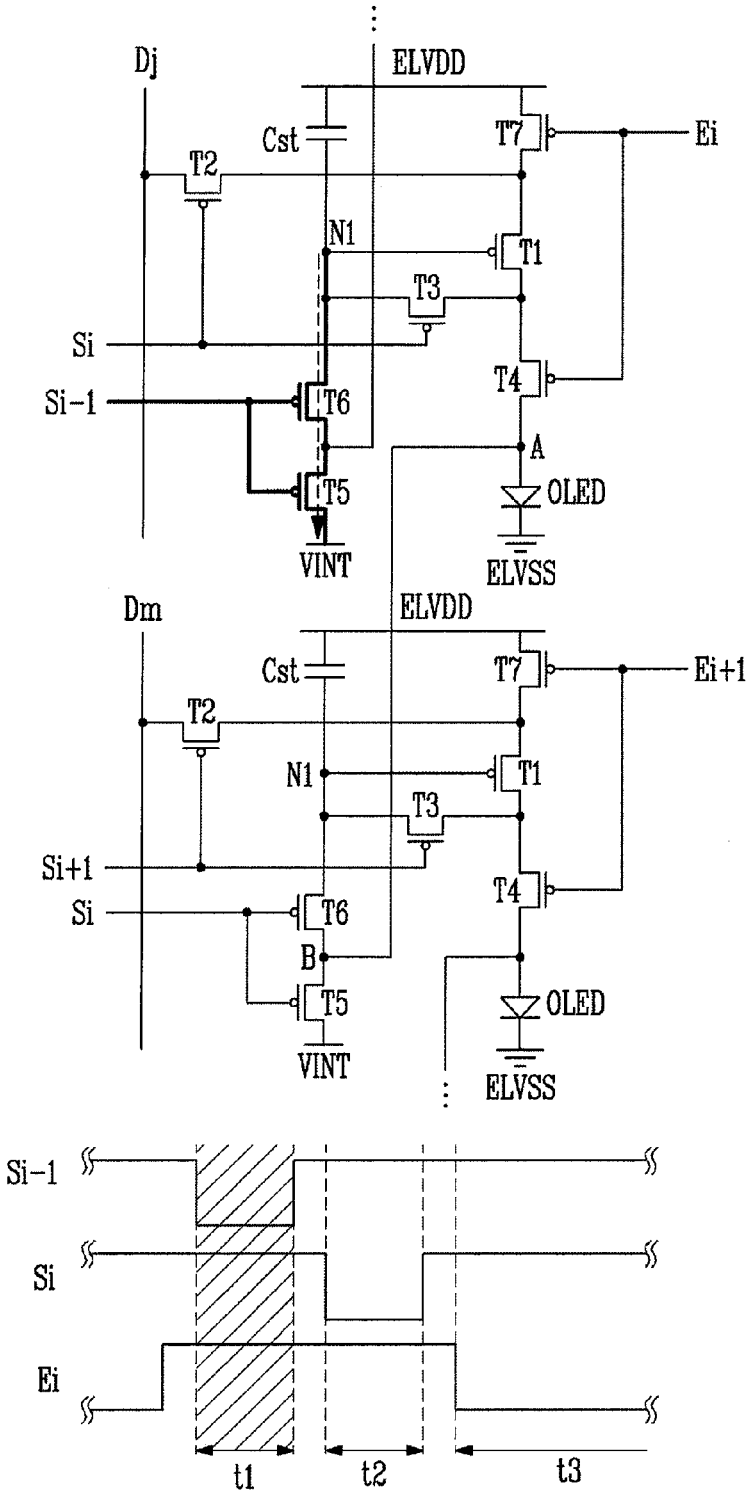
FIGS. 5A to 5C are circuit diagrams and waveform diagrams sequentially illustrating a method of driving the pixel of FIG. 3 driven by the driving signals of FIG. 4.
Figure 5B:
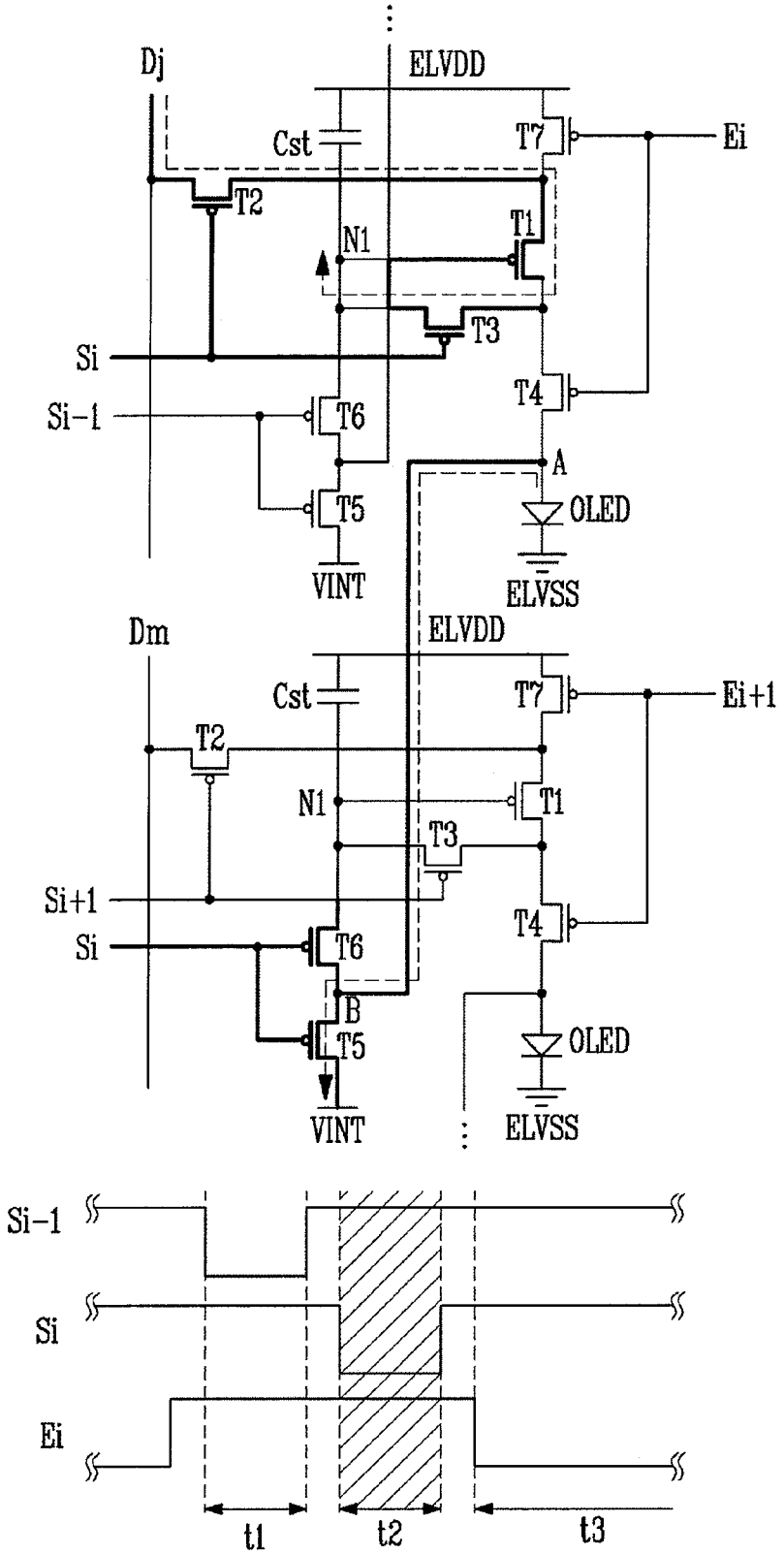
Figure 5C:
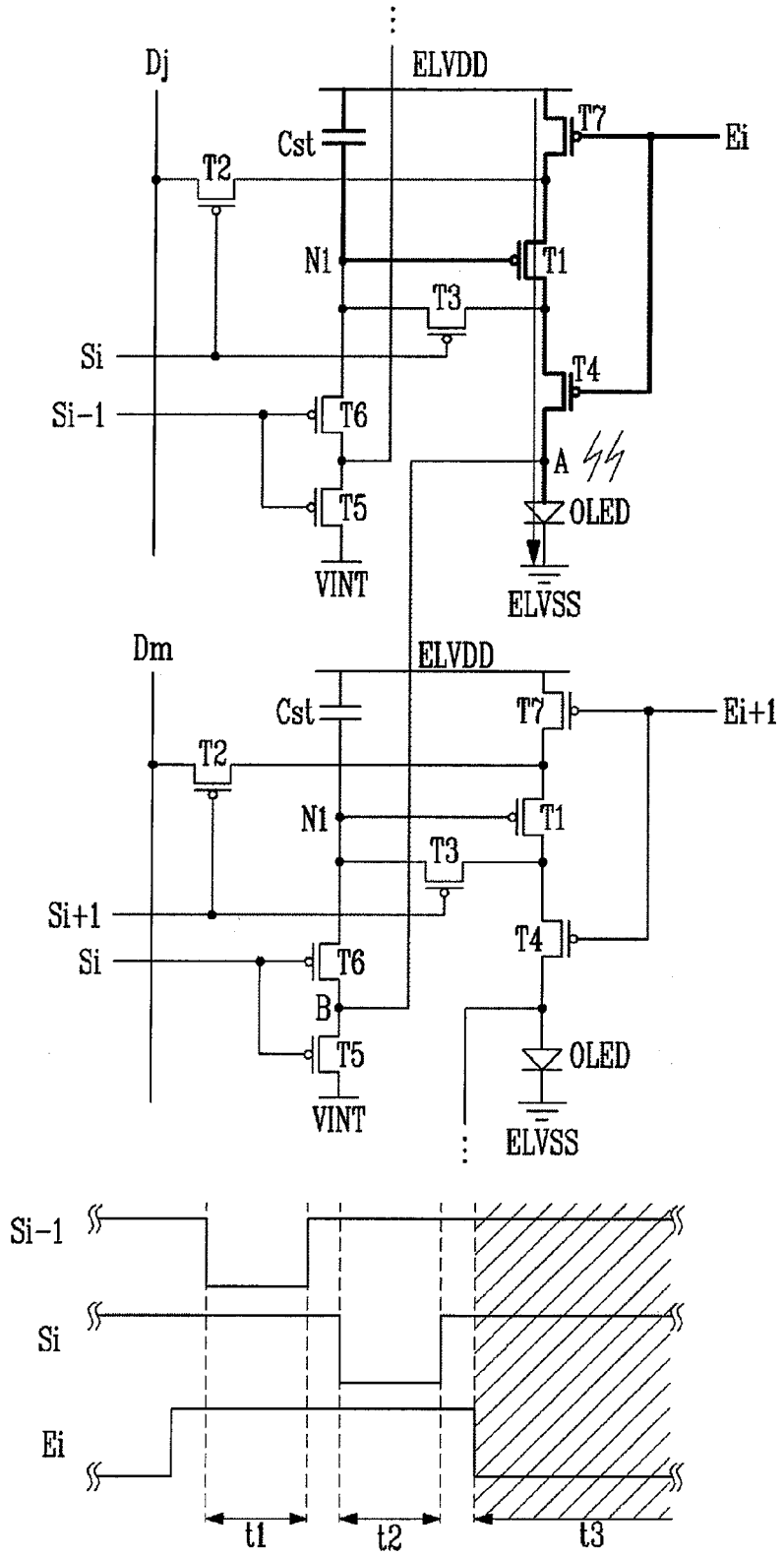

FIGS. 5A to 5C are circuit diagrams and waveform diagrams sequentially illustrating a method of driving the pixel of FIG. 3 driven by the driving signals of FIG. 4.

However, for convenience of the description, the operation will be described based on the first pixel arranged in the ith horizontal line among the pixels illustrated in FIG. 3.

First, referring to FIG. 5A, when a previous scan signal with a low voltage is supplied to the previous scan line Si−1 for a first period t1 for which the previous scan signal is supplied to the previous scan line Si−1, the fifth and sixth transistors T5 and T6 are turned on, so that a voltage of the third power source VINT is transmitted to the first node N1 (a direction of an arrow of FIG. 5A is illustrated considering that a voltage of the first node N1 is set to a voltage equal to or higher than a voltage of the third power source VINT before the first period t1).

Here, the voltage of the third power source VINT may be set to be lower than a voltage low enough to initialize the first node N1, for example, the lowest voltage among gray voltages of a data signal (the highest gray voltage in a case where the driving transistor is a PMOS transistor), and may be set to a voltage lower than a threshold voltage of the first transistor T1. Accordingly, the first transistor T1 is diode-connected in a forward direction for a next data programming period t2, so that the data signal is stably transmitted to the first node N1 via the first transistor T1 and the third transistor T3.

In the meantime, in the present exemplary embodiment, the exemplary embodiment in which the separate third power source VINT is used (utilized) as the initialization power source, but the present invention is not essentially limited thereto. For example, the second electrode of the fifth transistor T5 may be connected to the second power source ELVSS and the second power source ELVSS may also be used (utilized) as the initialization power source.

The voltage of the third power source VINT for the initialization is set to the low voltage, and the first transistor T1 is also turned on for the initialization period t1 for which the previous scan signal is supplied to the previous scan line Si−1.

In the meantime, the emission control signal with the high voltage is supplied to the emission control line Ei for the first period t1, so that the fourth and seventh transistors T4 and T7 are turned off.

Next, as illustrated in FIG. 5B, the current scan signal with the low voltage is supplied to the current scan line Si for the second period t2. However, the current scan signal in the ith horizontal line becomes the previous scan signal based on the i+1th horizontal line.

Then, the second and third transistors T2 and T3 are turned on, and the first transistor T1 is diode-connected by the third transistor T3.

A data signal is supplied to the data line Dj for the second period t2, and the data signal is transmitted to the first node N1 via the second transistor T2, the first transistor T1, and the third transistor T3. In this case, the first transistor T1 is in the diode-connected state, so that a voltage difference between the data signal of the first node N1 and the threshold voltage of the first transistor T1 is transmitted to the first node N1.

That is, the second period t2 is a data programming and threshold voltage compensation period for which the data signal and the voltage corresponding to the threshold voltage of the first transistor T1 are applied to the first node N1, and the voltage transmitted to the first node N1 for a third period t3 is stored in the storage capacitor Cst.

Further, as illustrated, the exemplary embodiment of the present invention is characterized by forming wiring connecting the connection node A connected with the anode electrode of the organic light emitting diode of the first pixel arranged in the ith horizontal line and the connection node B between the initialization transistors T5 and T6 of the second pixel arranged in the i+1th horizontal line while being adjacent to the first pixel (but not the same pixel). Accordingly, the initialization transistors T5 and T6 of the second pixel are turned on for the second period t2, and thus a current path to the third power source Vint from the anode electrode of the organic light emitting diode of the first pixel via the fifth transistor T5 of the second pixel is formed.

That is, the organic light emitting diode OLED of the first pixel is prevented from emitting light by making a leakage current, which may flow in the organic light emitting diode OLED of the first pixel, bypass and flow to the fifth transistor T5 of the second pixel before the emission period t3 for which the first pixel emits light, so that an increase in black luminance is prevented.

Further, the organic light emitting diode OLED of the first pixel is discharged for the second period t2 through the current path of the wiring connecting the connection node A of the first pixel and the connection node B of the second pixel, thereby reducing or minimizing an influence by the leakage current applicable to the organic light emitting diode while displaying black data for the subsequent emission period t3.

After the supply of the current scan signal to the current scan line Si is completed, as illustrated in FIG. 5C, the emission control signal with the low voltage is supplied to the emission control line Ei for the third period t3.

Accordingly, the fourth and seventh transistors T4 and T7 are turned on, so that a driving current flows to the second power source ELVSS from the first power source ELVDD via the seventh transistor T7, the first transistor T1, the fourth transistor T4, and the organic light emitting diode OLED.

In this case, the driving current is controlled by the first transistor T1 in response to the voltage of the first node N1, and the voltage of the data signal and the voltage corresponding to the threshold voltage of the first transistor T1 have been stored in the first node N1 for the prior second period t2, so that the threshold voltage of the first transistor T1 is compensated for the third period t3, and the driving current is uniformly set in response to the data signal regardless of a threshold voltage deviation of the first transistor T1.

That is, the third period t3 is an emission period of the pixel, so that the organic light emitting diode OLED emits light with luminance corresponding to the data signal for the third period t3.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display device, comprising:

a scan driver configured to sequentially supply a scan signal to scan lines, and to supply an emission control signal to emission control lines;

a data driver configured to supply a data signal to data lines;

a pixel unit comprising a plurality of pixels connected with the scan lines, the emission control lines, and the data lines, and configured to receive a first power source which is a high potential pixel power source, a second power source which is a low potential pixel power source, and a third power source which is an initialization power source; and a wiring connecting an anode electrode of an organic light emitting diode of a first pixel of the pixels, the first pixel being arranged in a first horizontal line, and a first electrode of a transistor of a second pixel of the pixels, the transistor being connected with the third power source of the second pixel, the second pixel being arranged in a second horizontal line while being adjacent to the first pixel, wherein the first electrode of the transistor is connected to a node, the wiring is connected to the node, and the transistor is connected between the node and the third power source of the second pixel to form a current path from the anode electrode of the organic light emitting diode of the first pixel to the third power source of the second pixel.

2. The organic light emitting display device of claim 1, wherein each of the pixels includes:

an organic light emitting diode connected between the first power source and the second power source;

a first transistor connected between the first power source and the organic light emitting diode and comprising a gate electrode connected to a first node;

a second transistor connected between a first electrode of the first transistor connected to the first power source and a data line of the data lines and comprising a gate electrode connected to a current scan line of the scan lines;

a third transistor connected between a second electrode of the first transistor connected to the organic light emitting diode and the first node and comprising a gate electrode connected to the current scan line;

a fourth transistor connected between the second electrode of the first transistor and the organic light emitting diode and comprising a gate electrode connected to an emission control line of the emission control lines;

a fifth transistor connected between the first node and the third power source and comprising a gate electrode connected to a previous scan line of the scan lines; and a storage capacitor connected between the first power source and the first node.

3. The organic light emitting display device of claim 2, wherein each of the pixels further includes a sixth transistor connected between a first electrode of the fifth transistor and the first node, and gate electrodes of the fifth transistor and the sixth transistor are commonly connected to the previous scan line.

4. The organic light emitting display device of claim 3, wherein a connection node of the fourth transistor and the organic light emitting diode of the first pixel is connected to a connection node of the fifth transistor and the sixth transistor of the second pixel adjacent to the first pixel.

5. The organic light emitting display device of claim 4, wherein the fifth and sixth transistors of the second pixel are configured to be turned on for a period for which a current scan signal is applied to the first pixel, so that a current path from the anode electrode of the organic light emitting diode of the first pixel to the third power source via the fifth transistor of the second pixel is formed.

6. The organic light emitting display device of claim 2, wherein each of the pixels further includes a seventh transistor connected between the first power source and the first electrode of the first transistor and comprising a gate electrode connected to the emission control line.

7. The organic light emitting display device of claim 2, wherein the scan driver is configured to supply a first emission control signal, by which the fourth transistor is turned off, to the emission control line for a first period for which a previous scan signal is supplied to the previous scan line and a second period for which a current scan signal is supplied to the current scan line.

8. The organic light emitting display device of claim 7, wherein the scan driver is configured to supply a second emission control signal, by which the fourth transistor is turned on, to the emission control line for a third period after the first and second periods.

9. The organic light emitting display device of claim 8, wherein the first emission control signal is at a first voltage, and the second emission control signal is at a second voltage differing from the first voltage.

10. The organic light emitting display device of claim 1, wherein a voltage of the third power source is set to a voltage with a low level.

11. The organic light emitting display device of claim 10, wherein the voltage with the low level is set to be lower than a lowest voltage among gray voltages of the data signal.

12. The organic light emitting display device of claim 1, wherein the first pixel is configured to receive the data signal and the transistor of the second pixel is configured to be turned on concurrently.

13. The organic light emitting display device of claim 12, wherein the first pixel is configured to receive the data signal and the transistor of the second pixel is configured to be turned on by a same scan signal.

* * * * *